US009765483B2

(12) United States Patent
Esser et al.

(10) Patent No.: US 9,765,483 B2
(45) **Date of Patent: *Sep. 19, 2017**

(54) PRODUCTION OF PAPER, CARD AND BOARD

(71) Applicant: BASF SE, Ludwigshafen (DE)

(72) Inventors: Anton Esser, Limburgerhof (DE); Hans-Joachim Haehnle, Neustadt (DE)

(73) Assignee: BASF SE, Ludwigshafen (DE)

( * ) Notice: Subject to any disclaimer, the term of this patent is extended or adjusted under 35 U.S.C. 154(b) by 93 days.

This patent is subject to a terminal disclaimer.

(21) Appl. No.: 14/662,806

(22) Filed: Mar. 19, 2015

(65) Prior Publication Data

US 2015/0191875 A1 Jul. 9, 2015

Related U.S. Application Data

(63) Continuation of application No. 13/969,774, filed on Aug. 19, 2013, now Pat. No. 9,051,687.

(60) Provisional application No. 61/691,819, filed on Aug. 22, 2012.

(51) Int. Cl.

| | |
|---|---|
| ***D21H 21/20*** | (2006.01) |
| ***D21H 17/67*** | (2006.01) |
| ***D21H 17/37*** | (2006.01) |
| ***D21H 17/00*** | (2006.01) |
| ***D21H 21/18*** | (2006.01) |
| ***D21H 23/04*** | (2006.01) |

(52) U.S. Cl.

CPC ..... *D21H 21/20* (2013.01); *D21H 17/37* (2013.01); *D21H 17/375* (2013.01); *D21H 17/675* (2013.01); *D21H 17/74* (2013.01); *D21H 21/18* (2013.01); *D21H 23/04* (2013.01)

(58) Field of Classification Search

USPC ..... 162/158, 164.1, 164.3, 164.5, 164.6, 162/168.1–168.3, 181.1–181.8, 183, 185, 162/202, 205; 526/72, 274, 278, 286, 526/287, 303.1, 317.1, 318; 524/1, 524/555–556, 543, 567, 570, 599, 606, 524/609

See application file for complete search history.

(56) References Cited

U.S. PATENT DOCUMENTS

| | | | |
|---|---|---|---|
| 4,305,782 | A | 12/1981 | Ostreicher et al. |
| 5,039,757 | A | 8/1991 | Takaki et al. |
| 6,103,065 | A | 8/2000 | Humphreys et al. |
| 2008/0196851 | A1 | 8/2008 | Hund et al. |
| 2010/0186914 | A1 | 7/2010 | Jehn-Rendu et al. |
| 2010/0326614 | A1 | 12/2010 | Hund et al. |
| 2011/0079365 | A1 | 4/2011 | Haehnie et al. |
| 2012/0073773 | A1 | 3/2012 | Jehn-Rendu et al. |
| 2012/0205065 | A1 | 8/2012 | Esser |
| 2013/0139986 | A1 | 6/2013 | Faucher et al. |

FOREIGN PATENT DOCUMENTS

| | | | |
|---|---|---|---|
| DE | 689 21 598 | T2 | 7/1995 |
| EP | 0 377 313 | A2 | 7/1990 |
| EP | 0 780 513 | B1 | 1/2002 |
| JP | 56-8409 | | 1/1981 |
| JP | 11-228641 | | 8/1999 |
| JP | 2004-300634 | | 10/2004 |
| WO | WO 97/25367 | A1 | 7/1997 |
| WO | WO 2006/075115 | A2 | 7/2006 |
| WO | WO 2009/156274 | A1 | 12/2009 |
| WO | WO 2010/145956 | | 12/2010 |
| WO | WO 2012/175392 | A1 | 12/2012 |
| WO | WO 2014/029593 | A1 | 2/2014 |

OTHER PUBLICATIONS

Freeness Conversion Table, Aikawa Fiber Technologies, [online], no date, retrieved from the Internet, [retrieved Sep. 17, 2014], <URL: http://www.aikawagroup.com/freeness-conversion-table.php>.*

International Search Report issued Oct. 29, 2013 in Corresponding PCT/EP2013/066120 (with English translation of Category of cited documents).

Office Action with corresponds to the Japan Patent Application No. 15/527832 dated Apr. 10, 2017.

* cited by examiner

*Primary Examiner* — Dennis Cordray

(74) *Attorney, Agent, or Firm* — Oblon, McClelland, Maier & Neustadt, L.L.P.

(57) ABSTRACT

The present invention relates to a process for producing paper, card and board. The present invention is based on the discovery that controlling solids content during the process in a specified manner provide enhanced initial web strength of the paper prior to drying and allows for higher machine speeds in the paper production process as compared to known processes.

20 Claims, No Drawings

PRODUCTION OF PAPER, CARD AND BOARD

This application is a Continuation of U.S. application Ser. No. 13/969,774, filed on Aug. 19, 2013, which claims benefit of provisional application Ser. No. 61/691,819, filed on Aug. 22, 2012.

DESCRIPTION

The present invention relates to a process for production of paper, card and board comprising draining a filler-containing paper stock comprising at least one water-soluble polymer obtainable by Hofmann degradation of an acrylamide- and/or methacrylamide-containing polymer with sheet formation in the wire section and then pressing the paper in the press section.

The development of novel processes for production of paper takes place at various points in the process. Improved papers are obtained through novel feedstocks or else modified dosing processes. But faster and faster papermachines also impose novel requirements on the production process.

Initial wet web strength is one limiting factor on the way to any further increase in papermachine speed. Initial wet web strength limits the maximum force which can be exerted on a sheet which has just been formed in the papermachine, has traveled through the wire and press sections of the machine and passed into the dryer section. In the process, the sheet has to be pulled off from the press rolls. To be able to ensure papermachine operation without broken ends, the pull-off force applied at this point has to be distinctly less than the initial wet web strength of the moist paper. Increased initial wet web strength permits application of higher pull-off forces and hence faster papermachine operation, cf. EP-B-0 780 513.

Initial wet web strength is the strength of a never-dried paper. It is the strength of a wet as-produced paper after passing through the wire and press sections of the papermachine.

In the press section, the moist fibrous web is couched by a suction pickup roll or static underpressure element onto the press felt. The office of the press felt is to transport the fibrous web through press nips in various modified forms. The dry matter content of the web is up to not more than 55%, depending on the design of the press section and the composition of the paper stock. The dry matter content increases with the pressure exerted in the press on the passing paper web. The pressure and hence the dry matter content of the paper web can be varied within relatively wide limits in many papermachines.

It is known that initial wet web strength can be increased by increasing the solids content of the paper at the point between the press section and the dryer section in the production process. It is also possible to improve the solids content at this point in the process via additives for increasing drainage. But there are limits to this.

WO 2009/156274 teaches the use of amphoteric copolymers obtainable by copolymerization of N-vinylcarboxamide with anionic comonomers and subsequent hydrolysis of the vinylcarboxamide as a paper stock additive for enhancing the initial wet web strength of paper. The treatment takes place at the thick stuff stage or at the thin stuff stage in the paper production process for example.

Prior application WO 2012/175392 teaches the use of amphoteric copolymers based on acrylamide which are obtainable by copolymerization of acrylamide with anionic comonomers, as paper stock additive for enhancing the initial wet web strength of paper. The treatment takes place at the thick stuff stage in the paper production process. It is additionally necessary for the press section of the papermachine to be adjusted such that the dry matter content of the wet paper web leaving the press section exceeds the minimum value that depends on the stock composition.

It is further known for example to use polymers obtained by Hofmann degradation of an acrylamide- and/or methacrylamide-containing polymer for strength enhancement.

It is an object of the present invention to enhance the initial wet web strength of as-produced paper prior to transitioning into the dryer section in order to achieve higher machine speeds in the paper production process compared with existing processes.

We have found that this object is achieved by a process for production of paper, card and board comprising draining a filler-containing paper stock comprising at least one water-soluble polymer with sheet formation in the wire section and then pressing the paper in the press section, wherein a paper stock having a fibrous concentration in the range from 20 to 40 g/l has the at least one water-soluble polymer added to it, then the paper stock is diluted to a fibrous concentration in the range from 5 to 15 g/l, the diluted paper stock is drained to form a sheet and the sheet is pressed in the press section to a solids content G(x) wt % or greater and G(x) computes according to $$G(x)=48+(x-15)\cdot 0.4$$

where x is the numerical value of the filler content of the dry paper, card or board (in wt %) and G(x) is the numerical value of the minimum solids content (in wt %) to which the sheet is pressed, wherein the water-soluble polymer is obtainable by Hofmann degradation of an acrylamide- and/or methacrylamide-containing polymer with or without subsequent postcrosslinking.

The present invention further provides a process for production of paper, card and board comprising draining a filler-containing paper stock comprising at least one water-soluble polymer with sheet formation in the wire section and then pressing the paper in the press section, wherein a paper stock having a fibrous concentration in the range from 20 to 40 g/l has the at least one water-soluble polymer added to it, then the paper stock is diluted to a fibrous concentration in the range from 5 to 15 g/l, the diluted paper stock is drained to form a sheet and the sheet is pressed in the press section to a solids content 48 wt %, wherein the water-soluble polymer is obtainable by Hofmann degradation of an acrylamide- and/or methacrylamide-containing polymer and subsequent postcrosslinking.

Paper stock is hereinbelow to be understood as referring to a mixture of water and fibrous material and further comprising, depending on the stage in the paper, card or board production process, the water-soluble polymer, filler and optionally paper auxiliaries.

The dry matter content of paper is to be understood as meaning the solids content of paper, card, board and fibrous material as determined using the oven-drying method of DIN EN ISO 638 DE.

The term pigment herein is used in the same meaning as the term filler, since pigments are used as fillers in the production of paper. Filler, as is customary in paper production, is to be understood as meaning inorganic pigment.

The process of the present invention is used in the production of paper, card and board comprising draining a filler-containing paper stock. The filler content (x) of the paper, card and board can be in the range from 5 to 40 wt % based on the paper, card or board.

One preferable embodiment gives preference to a process for production of paper having a filler content in the range from 20 to 30 wt %. Wood-free papers are papers of this type for example.

A further preferable embodiment gives preference to a process for production of paper having a filler content in the range from 10 to 20 wt %. Papers of this type are used as packaging paper in particular.

A further preferable embodiment gives preference to a process for production of paper having a filler content in the range from 5 to 15 wt %. Papers of this type are used as newsprint in particular.

A further preferable embodiment gives preference to a process for production of paper having a filler content in the range from 25 to 40 wt %, for example SC papers.

The aqueous paper stock which, according to the present invention, comprises at least a water-soluble amphoteric polymer, fibrous material as well as filler is drained in the wire section to form a sheet and the sheet is pressed, i.e., further drained, in the press section. Press section drainage is to a minimum solids content, but can also extend beyond that. This lower limit to the solids content up to which pressing has to take place is hereinafter also referred to as limiting dry matter content or else as minimum solids content G(x), and is based on the pressed sheet, which is a mixture of paper stock and water. This limiting dry matter content up to which drainage is effected at a minimum is dependent on filler quantity. Hence the limiting dry matter content G(x) of a paper having a filler content of 30 or 15 wt % computes according to the formula $$G(x)=48+(x-15)\cdot 0.4$$

as $G(30)=48+(30-15)\cdot 0.4=54$ or, respectively, as $G(15)=48+(15-15)\cdot 0.4=48$.

In other words, to produce paper having a filler content of 30 wt %, the present invention provides for pressing in the press section to a solids content of at least 54 wt % in order that paper having good initial wet web strength may be obtained.

By contrast, to produce paper having a filler content of 15 wt % or less, the present invention provides for pressing in the press section to a solids content of at least 48 wt % in order that paper having good initial wet web strength may be obtained.

One embodiment of the invention comprises pressing in the press section to at least a solids content in the range from 49 to 55 wt % to produce paper, card and board having a filler content of 17 to 32 wt %.

Another embodiment of the invention comprises pressing in the press section to at least a solids content of 48 wt % to produce paper, card and board having a filler content of 15 wt % or less.

The fibers are treated according to the present invention by adding the water-soluble polymer to the paper stock at a fibrous concentration in the range from 20 to 40 g/l. A fibrous concentration of 20 to 40 g/l (corresponding to a fibrous concentration of 2 to 4 wt % based on the aqueous fibrous material) is typically what the thick stuff in paper production has. Thick stuff is distinguished from thin stuff, hereinafter to be understood as meaning a fibrous concentration in the range from 5 to 15 g/l. Following the treatment with water-soluble polymer, the paper stock is diluted with water to a fibrous concentration in the range from 5 to 15 g/l.

Virgin and/or recovered fibers can be used according to the present invention. Any softwood or hardwood fiber typically used in the paper industry can be used, examples being mechanical pulp, bleached and unbleached chemical pulp and also fibrous materials from any annual plants. Mechanical pulp includes for example groundwood, thermomechanical pulp (TMP), chemothermomechanical pulp (CTMP), pressure groundwood, semichemical pulp, high-yield pulp and refiner mechanical pulp (RMP). Sulfate, sulfite and soda chemical pulps can be used for example. Preference is given to using unbleached chemical pulp, also known as unbleached kraft pulp. Suitable annual plants for production of fibrous materials include for example rice, wheat, sugar cane and kenaf. Pulps can also be produced using wastepaper, used alone or in admixture with other fibrous materials. The wastepaper can come from a deinking process for example. However, it is not necessary to subject the wastepaper to be used to such a process. It is further also possible to proceed from fibrous mixtures formed from a primary stock and recycled coated broke.

In the case of bleached or unbleached chemical pulp, a fibrous material having a freeness of 20 to 30 SR can be used. The general rule is to use a fibrous material having a freeness of about 30 SR, which is beaten during pulp production. Preference is given to using fibrous material having a freeness of ≤30 SR.

Treating the fibrous material with the water-soluble polymer is done in aqueous suspension, preferably in the absence of other process chemicals customarily used in paper production. The treatment is effected in the paper production process by adding at least one water-soluble polymer to an aqueous paper stock having a fibrous concentration of 20 to 40 g/l. Particular preference is given to a version wherein a water-soluble polymer is added to the aqueous paper stock at a time prior to adding the filler. It is very particularly preferable for the addition to take place after adding the dry strength enhancer starch for example.

The water-soluble polymers are preferably added in an amount of 0.05 to 5.00 wt %, based on fibrous material (solids).

Typical application rates are for example from 0.5 to 50 kg and preferably from 0.6 to 10 kg of at least one water-soluble polymer per metric ton of a dry fibrous material. It is particularly preferable for the amounts of water-soluble polymer which are used to be in the range from 0.6 to 3 kg of polymer (solids), based per metric ton of dry fibrous material.

The time during which the water-soluble polymer acts on a purely fibrous/paper stock material from addition to sheet formation is for example in the range from 0.5 seconds to 2 hours, preferably in the range from 1.0 seconds to 15 minutes and more preferably in the range from 2 to 20 seconds.

In addition to the water-soluble polymer, inorganic pigment is added to the fibrous material as a filler. Useful inorganic pigments include any typical paper industry pigments based on metal oxides, silicates and/or carbonates, especially pigments from the group consisting of calcium carbonate, which can be used in the form of ground (GCC) lime, chalk, marble or precipitated calcium carbonate (PCC), talc, kaolin, bentonite, satin white, calcium sulfate, barium sulfate and titanium dioxide. Mixtures of two or more pigments can also be used.

The present invention utilizes inorganic pigments having an average particle size (volume average)≤0 μm, preferably in the range from 0.3 to 5 μm and especially in the range from 0.5 to 2 μm. Average particle size (volume average) is generally determined herein for the inorganic pigments and also the particles of the pulverulent composition by the method of quasi-elastic light scattering (DIN-ISO 13320-1) using a Mastersizer 2000 from Malvern Instruments Ltd. for example.

The inorganic pigment is preferably added after the water-soluble copolymer has been added. In a preferable embodiment, the addition of the inorganic pigment takes place at the stage at which the fibrous material is already in the form of thin stuff, i.e., at a fibrous concentration of 5 to 15 g/l.

In a further preferable embodiment, the inorganic pigment is added to thick stuff as well as thin stuff, the ratio of the two additions (thick stuff addition/thin stuff addition) preferably being in the range from 5/1 to 1/5.

In addition to the water-soluble polymer, customary paper auxiliaries may optionally be added to the paper stock, generally at a fibrous concentration of 5 to 15 g/l. Conventional paper auxiliaries include for example sizing agents, wet strength agents, cationic or anionic retention aids based on synthetic polymers and also dual systems, drainage aids, other dry strength enhancers, optical brighteners, defoamers, biocides and paper dyes. These conventional paper additives can be used in the customary amounts.

Useful sizing agents include alkyl ketene dimers (AKDs), alkenylsuccinic anhydrides (ASAs) and rosin size.

Useful retention aids include for example anionic microparticles (colloidal silica, bentonite), anionic polyacrylamides, cationic polyacrylamides, cationic starch, cationic polyethyleneimine or cationic polyvinylamine. In addition, any desired combinations thereof are conceivable, for example dual systems consisting of a cationic polymer with an anionic microparticle or an anionic polymer with a cationic microparticle. To achieve high filler retention, it is advisable to add such retention aids as can be added for example to thin stuff as well as to thick stuff.

Dry strength enhancers are synthetic dry strength enhancers such as polyvinylamine, polyethyleneimine, glyoxylated polyacrylamide (PAM), amphoteric polyacrylamides or natural dry strength enhancers such as starch.

In the papermachine, these dry matter contents are set during passage through the press section. In the press section, the moist fibrous web is couched by a suction pickup roll or static underpressure element onto the press felt. The office of the press felt is to transport the fibrous web through press nips in various modified forms. The dry matter content of the web is up to not more than 55%, depending on the design of the press section and the composition of the paper stock. The dry matter content increases with the pressure exerted in the press on the passing paper web. The pressure and hence the dry matter content of the paper web can be varied within relatively wide limits in many papermachines.

The water-soluble polymer used according to the present invention is obtainable by Hofmann degradation of an acrylamide- and/or methacrylamide-containing polymer with or without subsequent postcrosslinking.

Prepolymer

These acrylamide- and/or methacrylamide-containing polymers, hereinafter also referred to as prepolymers, are obtainable by free-radically copolymerizing a monomer mixture comprising acrylamide and/or methacrylamide.

The acrylamide and methacrylamide monomers are present in polymerized form, individually or as a mixture, in proportions of 10 mol % to 100 mol %, preferably in proportions of 20 to 90 mol % and more preferably in proportions of 30 to 80 mol %, based on the monomer composition of the prepolymer.

The monomer mixture preferably has the following composition comprising:

a) acrylamide and/or methacrylamide (monomers a)

b) optionally one or more monoethylenically unsaturated monomers whose corresponding structural unit in the polymer is stable under the reaction conditions of Hofmann degradation, and/or DADMAC (diallyldimethylammonium chloride) (monomers b), (c) optionally one or more compounds having two or more ethylenically unsaturated moieties, and whose corresponding structural units in the polymer are stable under the reaction conditions of Hofmann degradation, except DADMAC is not encompassed (monomers c).

Examples of monoethylenically unsaturated monomers whose corresponding structural units in the polymer are stable under the reaction conditions of Hofmann degradation are nitriles of α,β-ethylenically unsaturated mono- and dicarboxylic acids, such as acrylonitrile and methacrylonitrile, amides of α,β-ethylenically unsaturated monocarboxylic acids and their N-alkyl and N,N-dialkyl derivatives, N-vinyllactams, nitrogenous heterocycles, vinylaromatics, $C_2$-$C_8$ monoolefins, α,β-ethylenically unsaturated mono- and dicarboxylic acids and salts thereof, anhydrides of α,β-ethylenically unsaturated mono- and dicarboxylic acids, ethylenically unsaturated sulfonic acids and salts thereof, ethylenically unsaturated phosphonic acids and salts thereof.

Examples of representatives of this group (b) are for instance N-methyl(meth)acrylamide, N-ethyl(meth)acrylamide, n-propyl(meth)acrylamide, N-(n-butyl)(meth)acrylamide, tert-butyl(meth)acrylamide, n-octyl(meth)acrylamide, 1,1,3,3-tetramethylbutyl(meth)acrylamide, ethylhexyl (meth)acrylamide, N, N-dimethylacrylamide, N, N-dimethylmethacrylamide, N-vinylformamide, N-methyl-N-vinylacetamide and mixtures thereof. Useful monomers (b) further include N-[2-(dimethylamino)ethyl]acrylamide, N-[2-(dimethylamino)ethyl]methacrylamide, N-[3-(dimethylamino)propyl]acrylamide, N-[3-dimethylamino)propyl] methacrylamide, N-[4-(dimethylamino)butyl]acrylamide, N-[4-(dimethylamino)butyl]methacrylamide, N-[4-(diethylamino)ethyl]acrylamide, N-[2-(diethylamino)ethyl]methacrylamide and mixtures thereof.

Useful monomers (b) further include N-vinyllactams and their derivatives, which may include one or more $C_1$-$C_6$ alkyl substituents (as defined above) for example. These include N-vinylpyrrolidone, N-vinylpiperidone, N-vinylcaprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam and mixtures thereof.

Useful monomers (b) further include N-vinylimidazoles and alkylvinylimidazoles, especially methylvinylimidazoles such as for example 1-vinyl-2-methylimidazole, 3-vinylimidazole N-oxide, 2-vinylpyridine N-oxide, 4-vinylpyridine N-oxide and also betainic derivatives and quaternization products thereof.

Diallyldimethylammonium chloride (DADMAC) is also suitable.

Useful additional monomers further include ethylene, propylene, isobutylene, butadiene, styrene, α-methylstyrene, vinyl acetate, vinyl propionate, vinyl chloride, vinylidene chloride, vinyl fluoride, vinylidene fluoride and mixtures thereof.

Also suitable are monomers bearing at least one acid function, i.e., at least one sulfonic acid group, phosphonic acid group or carboxylic acid group. The salts of the aforementioned compounds are also suitable. Examples are:

vinylsulfonic acid, allylsulfonic acid, methallylsulfonic acid, styrenesulfonic acid, acryl-amidomethylenephosphonic acid, 2-acrylamido-2-methylpropanesulfonic acid, vinylphosphonic acid, $CH_2{=}CH{-}NH{-}CH_2{-}PO_3H$, monomethyl vinylphosphonate, allylphosphonic acid, monomethyl allylphosphonate, acrylamidomethylpropylphosphonic acid.

Also suitable are monoethylenically unsaturated carboxylic acids having 3 to 8 carbon atoms and also the water-soluble salts such as alkali metal, alkaline earth metal or ammonium salts of these carboxylic acids and the monoethylenically unsaturated carboxylic anhydrides. This group of monomers includes for example acrylic acid, methacrylic acid, dimethacrylic acid, ethacrylic acid, α-chloroacrylic acid, maleic acid, maleic anhydride, fumaric acid, itaconic acid, mesaconic acid, citraconic acid, glutaconic acid, aconitic acid, methylenemalonic acid, allylacetic acid, vinylacetic acid and crotonic acid.

Monomers bearing acid groups may be in unneutralized, partially neutralized or completely neutralized form, in which case phosphonic acids may have either or both of the protons neutralized by suitable bases.

Examples of suitable bases for partially or completely neutralizing the acid groups of monomers are alkali metal or alkaline earth metal bases, ammonia, amines and/or alkanolamines. Examples thereof are sodium hydroxide, potassium hydroxide, sodium carbonate, potassium carbonate, sodium bicarbonate, potassium bicarbonate, magnesium hydroxide, magnesium oxide, calcium hydroxide, calcium oxide, triethanolamine, ethanolamine and morpholine.

The monomers of this group (b) can be used singly or mixed.

Examples of preferred monoethylenically unsaturated monomers whose corresponding structural units in the polymer are stable reaction conditions of Hofmann degradation are nitriles of α,β-ethylenically unsaturated mono- and dicarboxylic acids, such as acrylonitrile and methacrylonitrile, amides of α,β-ethylenically unsaturated monocarboxylic acids and their N-alkyl and N,N-dialkyl derivatives, N-vinyllactams and DADMAC.

The prepolymers preferably comprise not less than 5 mol %, preferably not less than 10 mol % and preferably not more than 90 mol %, more preferably not more than 70 mol % and even more preferably not more than 50 mol % of one or more monoethylenically unsaturated monomers whose corresponding structural unit in the polymer is stable under the reaction conditions of Hofmann degradation (monomer(s) b) in polymerized form, based on the total number of moles of monomers (a and b).

In addition, the prepolymers may comprise up to 5 wt %, preferably up to 3 wt %, more preferably up to 1 wt % and even more preferably up to 1 wt % and not less than 0.0001 wt %, especially not less than 0.001 wt % based on the total weight of monomers a and b used for the polymerization, of compounds having two or more ethylenically unsaturated moieties whose corresponding structural units in the polymer are stable under the reaction conditions of Hofmann degradation, in polymerized form, except DADMAC is not encompassed (monomers c).

Such a modification of the prepolymers by copolymerizing compounds having two or more ethylenically unsaturated moieties whose corresponding structural units in the polymer are stable under the reaction conditions of Hofmann degradation is achieved with methylenebisacrylamides, triallylamine, tetraallylammonium chloride or N,N'-divinylpropyleneurea for example.

It is particularly preferable for the monomer mixture used for preparing the prepolymer to have the following composition:

30 to 95 mol % of acrylamide and/or methacrylamide (monomers a), and 5 to 70 mol % of one or more monoethylenically unsaturated monomers whose corresponding structural unit in the polymer is stable under the reaction conditions of Hofmann degradation, and/or diallyldimethylammonium chloride (monomers b), and also up to 1.0 wt %, based on the total weight of monomers a and b, of one or more compounds having two or more ethylenically unsaturated moieties whose corresponding structural units in the polymer are stable under the reaction conditions of Hofmann degradation.

In a further preferred embodiment, the monomer mixture used for preparing the prepolymer has the following composition:

50 to 90 mol % of acrylamide and/or methacrylamide, and 10 to 50 mol % of one or more monoethylenically unsaturated monomers whose corresponding structural unit in the polymer is stable under the reaction conditions of Hofmann degradation, and/or diallyldimethylammonium chloride (monomers b)

and also up to 1.0 wt %, based on the total weight of monomers a and b, of one or more compounds having two or more ethylenically unsaturated moieties whose corresponding structural units in the polymer are stable under the reaction conditions of Hofmann degradation.

Preference for preparing the prepolymer is given to a monomer mixture of the following composition in particular:

60 to 80 mol % of acrylamide and/or methacrylamide (monomer a)

20 to 40 mol % of diallyldimethylammonium chloride (monomer b)

and also optionally from 0.001 to 0.1 wt %, based on the total amount of monomer a and monomer b, of one or more compounds selected from methylenebisacrylamides, triallylamine, tetraallylammonium chloride, N,N'-divinylpropyleneurea.

The prepolymers can be prepared by solution, precipitation, suspension, gel or emulsion polymerization. Solution polymerization in aqueous media is preferable. Useful aqueous media include water and mixtures of water and at least one water-miscible solvent, for example an alcohol, such as methanol, ethanol, n-propanol, isopropanol, etc.

Polymerization temperatures are preferably in a range from about 30 to 200° C. and more preferably from 40 to 110° C. The polymerization customarily takes place under atmospheric pressure, but it can also be carried out under reduced or superatmospheric pressure. A suitable pressure range extends from 0.1 to 10 bar.

The acid group-functional monomers (b) are preferably used in salt form.

To prepare the polymers, the monomers can be polymerized using initiators capable of forming free radicals.

Useful initiators for free-radical polymerization include the customary peroxo and/or azo compounds for this purpose, for example alkali metal or ammonium peroxydisulfates, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumene hydroperoxide, diisopropyl peroxydicarbamate, bis(o-toluoyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, azobisisobutyronitrile, azobis(2-amidonopropane) dihydrochloride or 2-2'-azobis(2-methylbutyronitrile). Also suitable are initiator mixtures or redox initiator systems, for example ascorbic acid/iron(II) sulfate/ sodium peroxodisulfate, tert-butyl hydroperoxide/sodium disulfite, tert-butyl hydroperoxide/sodium hydroxymethanesulfinate, $H_2O_2$/CuI.

The polymerization can be carried out in the presence of at least one chain transfer agent to control the molecular weight. Useful chain transfer agents include the customary compounds known to a person skilled in the art, e.g., sulfur compounds, e.g., mercaptoethanol, 2-ethylhexyl thioglycolate, thioglycolic acid, sodium hypophosphite, formic acid or dodecyl mercaptan and also tribromochloromethane or other compounds that have a controlling effect on the molecular weight of the polymers obtained.

The molar mass of the water-soluble prepolymer is for example at least 50 000 and preferably at least 100 000 daltons and more particularly at least 500 000 daltons. The molar masses of the prepolymer are then for example in the range from 50 000 to 10 million and preferably in the range from 100 000 to 5 million (determined by light scattering for example). This molar mass range corresponds for example to K values of 50 to 300 and preferably from 70 to 250 (determined by the method of H. Fikentscher in 5% aqueous sodium chloride solution at 25° C. and a polymer concentration of 0.1 wt %).

Hofmann Degradation

Hofmann degradation (also known as Hofmann rearrangement) is understood by a person skilled in the art to refer to the degradation of primary amides to amines with the loss of one carbon atom (Römpp Online, Version 3.12). In Hofmann degradation, the amide groups of the prepolymer are reacted with hypohalites under alkaline conditions and then the resulting carbamates are decarboxylated by acidification to obtain amino groups.

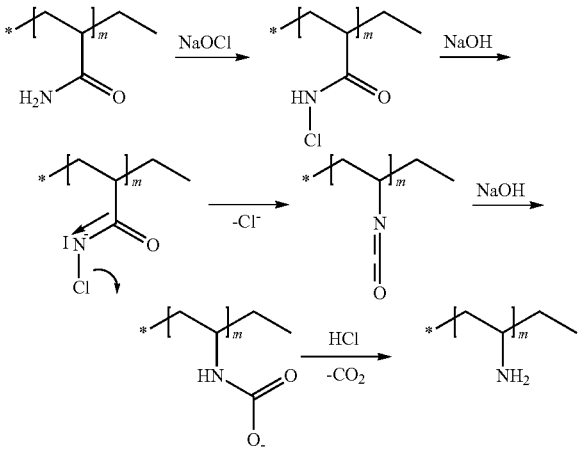

Polymers of this type are known from EP-A-0 377 313 and WO-A-2006/075115 for example. The preparation of polymers comprising vinylamine groups is exhaustively discussed for example in WO-A-2006/075115, page 4, line 25 to page 10, line 22 and also in the examples on pages 13 and 14, the content of which is hereby expressly incorporated herein by reference.

Hofmann degradation is preferably carried out in aqueous solution. From 0.1 to 2.0, preferably from 0.8 to 1.1 and more preferably 1.0 mol equivalent of hypohalite is used per mole equivalent of amide group. The strong base is used in amounts of 1.0 to 4.0 mol equivalents per mole equivalent of amide group, preferably from 1.5 to 3.0 mol equivalents and more preferably from 2.0 to 2.5 mol equivalents.

Sodium hypochlorite (NaOCl) and sodium hypobromite (NaOBr) are examples of hypohalites used, with NaOCl being preferred. Alkali metal hydroxides, alkaline earth metal hydroxides and alkaline earth metal oxides are used as strong base.

Hofmann degradation of the polymer is carried out, for example, in the temperature range from −15 to 90° C., preferably from −5 to 40° C., in the presence or absence of quaternary ammonium salts as a stabilizer to prevent any secondary reaction of the resulting amino groups with the amide groups of the starting polymer. On completion of the reaction with alkaline base/alkali metal hypochlorite, the aqueous reaction solution is introduced into a reactor containing an initially charged acid for decarboxylating the reaction product. The pH of the reaction product comprising vinylamine units is adjusted to a value in the range from 2 to 7.

The water-soluble polymer obtained by Hofmann degradation of an acrylamide- and/or methacrylamide-containing polymer can be used in the process of the present invention.

In a further version, the polymer obtained by Hofmann degradation of an acrylamide- and/or methacrylamide-containing polymer is additionally postcrosslinked.

Postcrosslinking

To raise the molecular weight of the Hofmann-degraded polymer and to obtain branched polymeric structures, the Hofmann-degraded polymer can additionally be reacted with crosslinkers. Crosslinkers in this context are compounds that bear two or more reactive groups capable of reacting with the primary amino groups of the Hofmann product.

Examples of useful crosslinkers include multifunctional epoxides such as bisglycidyl ethers of oligo- or polyethylene oxides or other multifunctional alcohols such as glycerol or sugars, multifunctional carboxylic esters, multifunctional isocyanates, multifunctional acrylic or methacrylic esters, multifunctional acrylic or methacrylic amides, epichlorohydrin, multifunctional acyl halides, multifunctional nitriles, α,ω-chlorohydrin ethers of oligo- or polyethylene oxides or of other multifunctional alcohols such as glycerol or sugars, divinyl sulfone, maleic anhydride or ω-halocarbonyl chlorides, multifunctional haloalkanes, especially α,ω-dichloroalkanes and carbonates such as ethylene carbonate or propylene carbonate. Further crosslinkers are described in WO-A-97/25367, pages 8 to 16.

Preference for use as crosslinkers is given to multifunctional epoxides such as bisglycidyl ethers of oligo- or polyethylene oxides or of other multifunctional alcohols such as glycerol or sugars.

The crosslinkers are optionally used in amounts up to 5.0 wt % preferably 20 ppm to 2 wt % based on the polymer obtained by Hofmann degradation.

The process of the present invention provides for paper-machine operation with fewer broken ends. Paper formed in the process exhibits distinctly enhanced initial wet web strength.

The examples which follow illustrate the invention. Percentages reported in the examples are by weight, unless otherwise stated.

EXAMPLES

The polymers are prepared in three consecutive steps:

a) preparing the prepolymer b) Hofmann degrading the prepolymer and optionally postcrosslinking.

Preparation of Polymer I a) Preparing Prepolymer I (70 Mol % of Acrylamide and 30 Mol % of DADMAC (Diallyldimethylammonium Chloride)—Unbranched)

A 2 l glass apparatus equipped with an anchor stirrer, a reflux condenser, an internal thermometer and a nitrogen inlet tube was initially charged with 295.5 g of distilled water, 189.6 g of a 65 wt % aqueous solution of DADMAC and 1.0 g of 75 wt % phosphoric acid. The pH was adjusted to 3 by adding 0.4 g of sodium hydroxide. Nitrogen was introduced to remove oxygen from the initial charge while the initial charge was heated to the polymerization temperature of 75° C. At the same time, the following feeds were prepared:

Feed 1: mixture of 253.0 g of a 50 wt % acrylamide solution, 60.0 g of distilled water and 0.9 g of sodium hydroxide Feed 2: 100 g of a 0.6% wt % aqeuous bisulfite solution Feed 3: 100 g of a 0.88 wt % aqueous sodium persulfate solution The three feeds were started at the same time. Feed 1 was added over a period of 2 hours, while feeds 2 and 3 were added over 5 hours. Thereafter, the temperature of the mixture was raised to 85° C. On completion of the addition of feeds 2 and 3 the batch was maintained at 85° C. for a further hour before being cooled down.

The prepolymer was obtained as a clear, viscous solution having a solids content of 25.6 wt % and a viscosity of 50 000 mPas (Brookfield LV viscosity, spindle 4, 6 rpm, RT).

b) Hofmann Degrading the Prepolymer 250.0 g of prepolymer I, obtained by a), were initially charged to a three-neck flask equipped with an internal thermometer and a blade stirrer and were cooled down to 8° C. with an ice/sodium chloride mixture under constant agitation.

The following feed was prepared: 234.5 g of a 14.1 wt % aqueous NaOCl solution and 20.5 g of distilled water were initially charged to a glass beaker and cooled down to 5° C. with an ice bath. Under constant agitation, 71.1 g of a 50 wt % aqueous sodium hydroxide solution were added dropwise such that the temperature could be maintained below 10° C.

This feed was added dropwise to the cooled initial prepolymer charge from a cooled dropping funnel (<10° C.) in 80 minutes such that the temperature was maintained in the range 8-10° C. during the addition. Thereafter, the reaction mixture was warmed to 20° C. within 10 minutes and maintained at 20° C. for 30 minutes. Thereafter, 558.1 g of this mixture were added dropwise to 135 g of 37% hydrochloric acid under constant agitation and with vigorous evolution of gas.

Finally, the pH of the solution obtained was adjusted to pH 3.5 with 10.0 g of 25 wt % aqueous sodium hydroxide solution.

Polymer I was obtained as a clear, slightly viscous solution having a polymer content of 8.6 wt % and a viscosity of 39 mPas (Brookfield LV viscosity, spindle 1, 60 rpm, RT).

Preparation of Polymer II (Postcrosslinked)

309.8 g of polymer I were initially charged to a 500 ml three-neck flask equipped with a blade stirrer and were adjusted to pH 8.5 by adding 6.8 g of 50 wt % aqueous sodium hydroxide solution. Thereafter, the mixture was heated to 45° C. and admixed with 0.9 g of Grillbond G 1701 (from EMS). After 30 minutes' stirring at 45° C., the temperature was raised to 55° C. and the batch was maintained at 55° C. for 2 hours. During this period, the viscosity was observed to increase. After 2 hours, the batch was cooled down to room temperature, and adjusted to pH 3.0 by adding 8.0 g of 37% hydrochloric acid.

Polymer II was obtained as a clear, slightly viscous solution having a polymer content of 8.2 wt % and a viscosity of 190 mPas (Brookfield LV viscosity, spindle 2, 60 rpm, RT).

Preparation of Polymer III a) Preparing Prepolymer III (70 Mol % of Acrylamide and 30 Mol % of DADMAC, Triallylamine as Monomer c)

A 2 l glass apparatus equipped with an anchor stirrer, a reflux condenser, an internal thermometer and a nitrogen inlet tube was initially charged with 155.8 g of distilled water, 189.6 g of a 65 wt % aqueous solution of DADMAC and 1.0 g of 75 wt % phosphoric acid. The pH was adjusted to 3 by adding 0.4 g of sodium hydroxide. Nitrogen was introduced to remove oxygen from the initial charge while the initial charge was heated to the polymerization temperature of 75° C.

The following feeds were provided:

Feed 1: 0.5 g of triallylamine was dissolved in 160.0 g of distilled water by addition of 0.75 g of 75 wt % phosphoric acid. Thereafter, 253.0 g of a 50 wt % acrylamide solution were added and the pH was adjusted to 4.0 with 0.4 g of 25 wt % aqueous sodium hydroxide solution.

Feed 2: 120 g of a 0.6% wt % aqueous bisulfite solution

Feed 3: 120.6 g of a 0.88 wt % aqueous sodium persulfate solution

The 3 feeds were started at the same time. Feed 1 was added over a period of 3 hours, while feeds 2 and 3 were run in over 6 hours. On completion of the addition of feed 2, the temperature was raised to 85° C. and the batch was maintained at 85° C. for a further hour before being cooled down.

The prepolymer was obtained as a clear, viscous solution having a solids content of 25.5 wt % and a viscosity of 15 800 mPas (Brookfield LV viscosity, spindle 4, 6 rpm, RT).

b) Hofmann Degradation of Prepolymer III 250.0 g of prepolymer III, obtained by a), were initially charged to a three-neck flask equipped with an internal thermometer and a blade stirrer and were cooled down to 8° C. with an ice/sodium chloride mixture under constant agitation.

The following feed was prepared: 234.5 g of a 14.1 wt % aqueous NaOCl solution and 20.5 g of distilled water were initially charged to a glass beaker and cooled down to 5° C. with an ice bath. Under constant agitation, 71.1 g of a 50 wt % aqueous sodium hydroxide solution were added dropwise such that the temperature could be maintained <10° C.

This feed was added dropwise to the initial charge from a cooled dropping funnel (<10° C.) in 80 minutes such that the temperature was maintained in the range 8-10° C. during the addition. Thereafter, the reaction mixture was warmed to 20° C. within 10 minutes and maintained at 20° C. for 60 minutes. Thereafter, 566.2 g of this mixture were added dropwise to 135 g of 37% hydrochloric acid under constant agitation and with vigorous evolution of gas.

Finally, the pH of the solution obtained was adjusted to pH 3.5 with 12.2 g of 25 wt % aqueous sodium hydroxide solution.

Polymer III was obtained as a clear, slightly viscous solution having a polymer content of 8.6 wt % and a viscosity of 23 mPas (Brookfield LV viscosity, spindle 1, 60 rpm, RT).

Polymer IV (Postcrosslinked)

301.8 g of polymer III were initially charged to a 500 ml three-neck flask equipped with a blade stirrer and were adjusted to pH 8.5 by adding 6.2 g of 50 wt % aqueous sodium hydroxide solution. Thereafter, the mixture was heated to 45° C. and admixed with 0.43 g of Grillbond G 1701 (from EMS). After 30 minutes' stirring at 45° C., the temperature was raised to 55° C. and the batch was maintained at 55° C. for 3 hours. During this period, the viscosity was observed to increase. After 3 hours, the batch was cooled down to room temperature, and adjusted to pH 3.0 by adding 7.4 g of 37% hydrochloric acid.

Polymer IV was obtained as a clear, slightly viscous solution having a polymer content of 8.2% and a viscosity of 419 mPas (Brookfield LV viscosity, spindle 2, 60 rpm, RT).

Preparation of Polymer V a) Preparing Prepolymer V (70 Mol % of Acrylamide and 30 Mol % of DADMAC, Triallylamine as Monomer c)

A 2 l glass apparatus equipped with an anchor stirrer, a reflux condenser, an internal thermometer and a nitrogen inlet tube was initially charged with 155.8 g of distilled water, 189.6 g of a 65 wt % aqueous solution of DADMAC and 1.0 g of 75 wt % phosphoric acid. The pH was adjusted to 3 by adding 0.4 g of NaOH. Nitrogen was introduced to remove oxygen from the initial charge while the initial charge was heated to the polymerization temperature of 75° C. At the same time the following feeds were prepared:

Feed 1: 0.25 g of triallylamine was dissolved in 160.0 g of distilled water by addition of 0.75 g of 75 wt % phosphoric acid. Thereafter, 253.0 g of a 50 wt % acrylamide solution were added and the pH was adjusted to 4.0 with 0.6 g of 25 wt % aqueous sodium hydroxide solution.

Feed 2: 120 g of a 0.6% wt % aqeuous bisulfite solution

Feed 3: 120.6 g of a 0.88 wt % aqueous sodium persulfate solution

The 3 feeds were started at the same time. Feed 1 was added over a period of 3 hours, while feeds 2 and 3 were run in over 6 hours. On completion of the addition of feed 2, the temperature was raised to 85° C. On completion of the addition of feeds 2 and 3, the batch was maintained at 85° C. for a further hour before being cooled down.

The prepolymer was obtained as a clear, viscous solution having a solids content of 25.5 wt % and a viscosity of 12 400 mPas (Brookfield LV viscosity, spindle 4, 6 rpm, RT).

b) Hofmann Degradation of the Prepolymer 250.0 g of prepolymer V, obtained by a), were initially charged to a three-neck flask equipped with an internal thermometer and a blade stirrer and were cooled down to 8° C. with an ice/sodium chloride mixture under constant agitation.

At the same time the following feed stream was prepared:

234.5 of a 14.1 wt % aqueous NaOCl solution and 20.5 g of distilled water were initially charged to a glass beaker and cooled down to 5° C. with an ice bath. Under constant agitation, 71.1 g of a 50 wt % NaOH solution were added dropwise such that the temperature could be maintained <10° C.

This feed was added dropwise to the initial charge from a cooled dropping funnel (<10° C.) in 80 minutes such that the temperature was maintained in the range 8-10° C. during the addition. Thereafter, the reaction mixture was warmed to 20° C. within 10 minutes and maintained at 20° C. for 60 minutes. Thereafter, 566.2 g of this mixture were added dropwise to 135 g of 37% hydrochloric acid under constant agitation and with vigorous evolution of gas.

Finally, the pH of the solution obtained was adjusted to pH 3.5 with 16.0 g of 25 wt % aqueous sodium hydroxide solution.

Polymer V was obtained as a clear, slightly viscous solution having a polymer content of 8.5% and a viscosity of 22 mPas (Brookfield LV viscosity, spindle 1, 60 rpm, RT).

Polymer VI (Postcrosslinked)

314.4 g of polymer V were initially charged to a 500 ml three-neck flask equipped with a blade stirrer and were adjusted to pH 8.5 by adding 6.4 g of 50 wt % aqueous sodium hydroxide solution. Thereafter, the mixture was heated to 45° C. and admixed with 0.44 g of Grillbond G 1701 (from EMS). After 30 minutes' stirring at 45° C., the temperature was raised to 55° C. and the batch was maintained at 55° C. for 3 hours. During this period, the viscosity was observed to increase. After 3 hours, the batch was cooled down to room temperature, and adjusted to pH 3.0 by adding 7.6 g 37% hydrochloric acid.

Polymer VI was obtained as a clear, slightly viscous solution having a polymer content of 8.1% and a viscosity of 190 mPas (Brookfield LV viscosity, spindle 2, 60 rpm, RT).

Polymer VII (85 Mol % of Acrylamide and 15 Mol % of Acrylic Acid)

In accordance with JP63042998 (see table on page 624), the C-4 Hofmann product was emulated.

Polymer VIII (not in Accordance with the Present Invention) (Comparative Example Corresponds to Polymer I from EP Application Numbered 11170740.2)

A 2 l 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:

250 g of deionized water 95.6 g of 50 wt % aqueous acrylamide solution 121.9 g of 80 wt % aqueous solution of acryloyloxyethyltrimethylammonium chloride 148.1 g of 32 wt % aqueous sodium acrylate solution 0.2 g of 1 wt % aqueous solution of diethylenetriaminepentaacetic acid.

About 32 g of 37% hydrochloric acid were added to set pH 4.1.

Feed 2: 60.0 g of 1 wt % aqueous solution of 2,2'-azobis (2-amidinopropane) dihydrochloride Feed 3: 16.5 g of 1 wt % aqueous solution of 2,2'-azobis (2-amidinopropane) dihydrochloride The initial charge was heated to 63° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 2 the reaction was maintained at 63° C. for a further hour and then heated to 72° C. while the vacuum was reduced accordingly. The reaction mixture was maintained at 72° C. for a further 2 hours, at which point feed 3 was added all at once to initiate a 2 hour period of secondary polymerization at 72° C. The vacuum was then lifted and the batch was diluted with 500 g of deionized water and cooled down to room temperature. 208 g of water were distilled off during the entire polymerization.

A clear, colorless, viscous solution was obtained of polymer VIII composed of 40 mol % acrylamide, 30 mol % acryloyloxyethyltrimethylammonium chloride and 30 mol % sodium acrylate.

Solids content: 14.5 wt %

Viscosity: 10 600 mPas (Brookfield, spindle 7, 50 rpm, room temperature)

K value 120 (0.1% solution of polymer in 5 wt % aqueous sodium chloride solution)

Polymer IX (not in Accordance with the Present Invention): (Comparative Example Corresponds to Polymer II from EP Application Numbered 11170740.2)

A 2 l 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:

250 g of deionized water 119.5 g of 50 wt % aqueous acrylamide solution 113.8 g of 80 wt % aqueous solution of acryloyloxyethyltrimethylammonium chloride 108.6 g of 32 wt % aqueous sodium acrylate solution 0.2 g of 1 wt % aqueous solution of diethylenetriaminepentaacetic acid.

About 38 g of 37% hydrochloric acid were added to set pH 4.1.

Feed 2: 63.5 g of 1% aqueous solution of 2,2'-azobis(2-amidinopropane) dihydrochloride Feed 3: 17.0 g of 1% aqueous solution of 2,2'-azobis(2-amidinopropane) dihydrochloride.

The initial charge was heated to 66° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 2 the reaction was maintained at 66° C. for a further hour and then heated to 78° C. while the vacuum was reduced accordingly. The reaction mixture was maintained at 78° C. for a further 2 hours, at which point feed 3 was added all at once to initiate a 2 hour period of secondary polymerization at 78° C. The vacuum was then lifted and the batch was diluted with 500 g of deionized water and cooled down to room temperature. 200 g of water were distilled off during the entire polymerization.

A clear, colorless, viscous solution was obtained of polymer IX composed of 50 mol % acrylamide, 28 mol % acryloyloxyethyltrimethylammonium chloride and 22 mol % sodium acrylate.

Solids content: 14.1 wt %

Viscosity: 42 000 mPas (Brookfield, spindle 7, 50 rpm, room temperature)

K value 125 (0.1% solution of polymer in 5 wt % aqueous sodium chloride solution)

Polymer X (not in Accordance with the Present Invention) (Corresponds to Polymer III from EP Application Numbered 11170740.2)

A 2 l 5-neck flask equipped with an anchor stirrer, a thermometer, a descending condenser and a nitrogen inlet tube was initially charged with 400 g of deionized water. In addition, the following feeds were provided:

Feed 1: The following components were mixed in a glass beaker:

250 g of deionized water 71.7 g of 50 wt % aqueous acrylamide solution 130.1 g of 80 wt % aqueous solution of acryloyloxyethyltrimethylammonium chloride 187.8 g of 32 wt % aqueous sodium acrylate solution 0.2 g of 1 wt % aqueous solution of diethylenetriaminepentaacetic acid.

About 34 g of 37% hydrochloric acid were added to set pH 4.1.

Feed 2: 60.3 g of 1 wt % aqueous solution of 2,2'-azobis (2-amidinopropane) dihydrochloride Feed 3: 16.0 g of 1 wt % aqueous solution of 2,2'-azobis (2-amidinopropane) dihydrochloride.

The initial charge was heated to 63° C. and a water jet pump was used to reduce the pressure until the water just started to boil. Feeds 1 and 2 were started at the same time, feed 1 being added in 2 hours and feed 2 in 3 hours to the initial charge at constant internal temperature. Upon completion of feed 2 the reaction was maintained at 63° C. for a further hour and then heated to 72° C. while the vacuum was reduced accordingly. The reaction mixture was maintained at 72° C. for a further 2 hours, at which point feed 3 was added all at once to initiate a 2 hour period of secondary polymerization at 72° C. The vacuum was then lifted and the batch was diluted with 500 g of deionized water and cooled down to room temperature. 200 g of water were distilled off during the entire polymerization.

A clear, colorless, viscous solution was obtained of polymer X composed of 30 mol % acrylamide, 32 mol % acryloyloxyethyltrimethylammonium chloride and 38 mol % sodium acrylate.

Solids content: 14.8 wt %

Viscosity: 12 000 mPas (Brookfield, spindle 7, 50 rpm, room temperature)

K value 117 (0.1% solution of polymer in 5 wt % aqueous sodium chloride solution)

Testing of Above-Described Polymers I to X in Enhancing the Initial Wet Web Strength of Paper To simulate the sheet-forming process on the laboratory scale, the thin stuff in the examples has to be adjusted to a fibrous concentration of 3.5 g/l.

Pretreatment of Fibrous Suspension

Bleached birchwood sulfate pulp was beaten in a laboratory pulper at a fibrous concentration of 4% until it was free of fiber bundles and had reached a freeness of 30° SR. The beaten stuff was subsequently admixed with an optical brightener (Blankophor® PSG) and also with a fully destructurized cationic starch (HiCat® 5163 A) and left exposed to the action thereof for 5 minutes. The cationic starch had been destructurized beforehand as a 10% starch slurry in a jet cooker at 130° C. for 1 minute.

The amount of optical brightener added was 0.5 wt % of commercial product, based on the dry matter content of the fibrous suspension. The amount of cationic starch added was 0.8% of starch (solids), based on the dry matter content of the fibrous suspension. The fiber content of the fibrous suspension after starch and optical brightener had been added was 3.5% (35 g/l).

Examples 1 to 7

Seven glass beakers were each filled with 50 g of the above-described pretreated fibrous suspension. Each of the glass beakers had added to it 1.75 g of a 1 wt % aqueous solution of one of the above-described polymers I to VII under gentle stirring of the fibrous suspension (corresponds to 1% of polymer (solids) per fibrous material (solids)). The fibrous suspensions were each subsequently reduced to a fibrous concentration of 0.35% by addition of water. This was followed by addition of a 20 wt % carbonate pigment slurry (PCC, Syncarb F474 from Omya). The amount of pigment suspension (corresponds to filler suspension) added was adjusted in multiple preliminary tests such that the pigment content of the laboratory sheets subsequently formed was about 20%. The fibrous suspension two minutes after pigment addition was processed on a Rapid-Köthen sheet-former to ISO 5269/2 into sheets having a grammage of 100 g/sqm. The wet sheets were subsequently removed from the wire frame and placed between two suction felts. The pack consisting of suction felts and the wet paper was subsequently pressed in a static press at a press pressure of 6 bar. In each case, pressing was done to a 50 wt % solids content of the wet sheets.

Examples 8, 9 and 10 (not According to the Invention)

Three glass beakers were each filled with 50 g of the above-described pretreated fibrous suspension. Each of the glass beakers had added to it 1.75 g in each case of a 1 wt % aqueous solution of one of the above-described polymers I-III under gentle stirring of the fibrous suspension (corresponds to 1% of polymer (solids) per fibrous material (solids)). The fibrous suspensions were each subsequently reduced to a fibrous concentration of 0.35% by addition of water. This was followed by addition of a 20 wt % carbonate pigment slurry (PCC, Syncarb F474 from Omya). The amount of pigment suspension added was adjusted in multiple preliminary tests such that the pigment content of the laboratory sheets subsequently formed was about 20%. The fibrous suspension two minutes after pigment addition was processed on a Rapid-Köthen sheet-former to ISO 5269/2 into sheets having a grammage of 100 g/sqm. The wet sheets were subsequently removed from the wire frame and placed between two suction felts. The pack consisting of suction felts and the wet paper was subsequently pressed in a static press at a press pressure of 6 bar. By adapting the residence time within the press arrangement, pressing was in each case carried on to a solids content of the wet sheets which is discernible from Table 1.

Examples 11, 12 and 13

Three glass beakers were each filled with 50 g of the above-described pretreated fibrous suspension. Each of the glass beakers had added to it 1.75 g of a 1 wt % aqueous solution of one of the above-described polymers VIII to X under gentle stirring of the fibrous suspension (corresponds to 1% of polymer (solids) per fibrous material (solids)). The fibrous suspensions were each subsequently reduced to a fibrous concentration of 0.35% by addition of water. This was followed by addition of a 20 wt % carbonate pigment slurry (PCC, Syncarb F474 from Omya). The amount of pigment suspension (corresponds to filler suspension) added was adjusted in multiple preliminary tests such that the pigment content of the laboratory sheets subsequently formed was about 20%. The fibrous suspension two minutes after pigment addition was processed on a Rapid-Köthen sheet-former to ISO 5269/2 into sheets having a grammage of 100 g/sqm. The wet sheets were subsequently removed from the wire frame and placed between two suction felts. The pack consisting of suction felts and the wet paper was subsequently pressed in a static press at a press pressure of 6 bar. In each case, pressing was done to a 50 wt % solids content of the wet sheets.

Examples 14, 15 and 16 (not According to the Invention—Addition to Thin Stuff)

Three glass beakers containing 50 g of the pretreated fibrous suspension (thick stuff) were diluted with 450 g of water to a fibrous concentration of 0.35% (corresponds to 3.5 g/l).

To 500 g in each case of the diluted fibrous suspension (thin stuff) were added 1.75 g of a 1 wt % aqueous solution of polymer I, II or III (corresponds to 1 wt % of polymer (solids) based on fibrous material (solids)).

This was followed by addition of a 20 wt % carbonate pigment slurry (PCC, Syncarb F474 from Omya) to the mixture. The amount of pigment suspension added was adjusted in multiple preliminary tests such that the pigment content of the laboratory sheets subsequently formed was about 20%.

The fibrous suspension two minutes after pigment addition was processed on a Rapid-Köthen sheet-former to ISO 5269/2 into sheets having a grammage of 100 g/sqm. The wet sheets were subsequently removed from the wire frame and placed between two suction felts. The pack consisting of suction felts and the wet paper was subsequently pressed in a static press at a press pressure of 6 bar. By adapting the residence time of the papers within the press arrangement, pressing was in each case carried on to a 50 wt % solids content of the wet sheets.

Examples 17 and 18 (Reference)

Three glass beakers were each filled with 50 g of the above-described pretreated fibrous suspension. The fibrous suspensions were each subsequently reduced to a fibrous concentration of 0.35% by addition of water. This was followed by addition of a 20 wt % carbonate pigment slurry (PCC, Syncarb F474 from Omya). The amount of pigment suspension (corresponds to filler suspension) added was adjusted in multiple preliminary tests such that the pigment content of the laboratory sheets subsequently formed was about 20%. The fibrous suspension two minutes after pigment addition was processed on a Rapid-Köthen sheet-former to ISO 5269/2 into sheets having a grammage of 100 g/sqm. The wet sheets were subsequently removed from the wire frame and placed between two suction felts. The pack consisting of suction felts and the wet paper was subsequently pressed in a static press at a press pressure of 6 bar. The pressing time was varied to produce not only sheets of differing dry matter content (see Table 1)

Performance Testing: Determination of Initial Wet Web Strength

Initial wet web strength must not be confused with a paper's wet strength and initial wet strength since both these properties are measured on papers which, after drying, are moistened back to a defined water content. Initial wet strength is an important parameter in the assessment of papers without permanent wet strength. A dried and subsequently remoistened paper has a completely different wet strength than a moist paper directly after it has passed through the wire and press sections of a papermachine.

Initial wet web strength is determined on wet paper using the Voith method (cf. M. Schwarz and K. Bechtel "Initiale Gefügefestigkeit bei der Blattbildung", in Wochenblatt für Papierfabrikation 131, pages 950-957 (2003) No. 16). The wet sheets after pressing in the static press were knocked off onto a plastics support and transferred to a cutting support. Test strips having a defined length and width were then cut out of the sheet. They were pressed under constant pressure until the desired dry matter content was reached. To investigate the sheets of paper obtained according to the examples reported above, four dry matter contents ranging between 42% and 58% were established in each case. These values were used to determine initial wet web strength at 50% dry matter using a fitting method described in the abovementioned literature reference. The actual measurement of initial wet web strength took place on a vertical tensile tester using a special clamping device. The force determined in the tension machine was converted into the grammage-independent INF index. For an exact description of the clamping device, the measuring procedure, the determination of the dry matter in the paper and the data processing, the above-mentioned literature reference can be enlisted.

The results of the tests are reproduced in Table 1.

TABLE 1

Results of performance testing for production of paper having a filler content of 20 wt %. According to the computation of the limiting dry matter content G(x) = G(20), the invention requires pressing to a solids content of at least 50 wt %: G(20) = 48 + (20 − 15) · 0.4 = 50

| Example | Polymer | INF index [Nm/g] | Solids content pressed [%] |
|---|---|---|---|
| 1 | I | 3.9 | 50.3 |
| 2 | II | 3.5 | 50.5 |
| 3 | III | 3.3 | 50.2 |
| 4 | IV | 3.4 | 50.9 |
| 5 | V | 3.5 | 51.2 |
| 6 | VI | 3.6 | 50.6 |
| 7 | VII | 3.2 | 51.3 |
| 8 not according to the invention | I | 1.8 | 48.6 |
| 9 not according to the invention | II | 1.9 | 49.1 |
| 10 not according to the invention | III | 2.1 | 49.2 |
| 11 not according to the invention | VIII | 3.3 | 50.3 |
| 12 not according to the invention | IX | 3.1 | 50.5 |
| 13 not according to the invention | X | 2.9 | 50.2 |
| 14 (addition to thin stuff) not according to the invention | I | 1.8 | 50.2 |
| 15 (addition to thin stuff) not according to the invention | II | 1.5 | 50.0 |
| 16 (addition to thin stuff) not according to the invention | III | 1.7 | 51.2 |
| 17 reference | | 1.1 | 48.4 |
| 18 reference | | 1.4 | 50.6 |

We claim:

1. A process for producing paper, card and board having an enhanced initial wet web strength, comprising:

draining a paper stock comprising filler and at least one water-soluble polymer and having a fibrous concentration of 3.5 to 15 g/l on a wire section to form a sheet, and pressing the sheet on a press section to a solids content of G(x) wt % or greater, wherein G(x) is computed by the following equation:

$$G(x)=48+(x-15)\cdot 0.4,$$

x is the numerical value of the filler content of the dry paper, card or board, the water-soluble polymer is obtainable by Hofmann degradation of an acrylamide- and/or methacrylamide-containing polymer with or without subsequent post-crosslinking, and the acrylamide- and/or methacrylamide-containing polymer is obtainable by free-radically polymerizing a monomer mixture comprising:

(a) 50 to 90 mol % of acrylamide and/or methacrylamide, (b) 10 to 50 mol % of one or more monoethylenically unsaturated monomers whose corresponding structural unit in the polymer is stable under the reaction conditions of Hofmann degradation, and/or diallyldimethylammonium chloride, and (c) optionally up to 1.0 wt %, based on the total weight of monomers (a) and (b), of one or more compounds having two or more ethylenically unsaturated moieties whose corresponding structural units in the polymer are stable under the reaction conditions of Hofmann degradation, and the sheet has an INF index of 3.2 to 3.9 Nm/g.

2. The process of claim 1, wherein (b) is diallyldimethylammonium chloride.

3. The process of claim 1, wherein said monoethylenically unsaturated monomers whose corresponding structural unit in the polymer is stable under the reaction conditions of Hofmann degradation are selected from the group consisting of nitriles of α,β-ethylenically unsaturated mono- and dicarboxylic acids, amides of α,β-ethylenically unsaturated monocarboxylic acids and their N-alkyl and N,N-dialkyl derivatives, N-vinyllactams, nitrogenous heterocycles, vinylaromatics, $C_2$-$C_8$ monoolefins, α,β-ethylenically unsaturated mono- and dicarboxylic acids and salts thereof, anhydrides of α,β-ethylenically unsaturated mono- and dicarboxylic acids, ethylenically unsaturated sulfonic acids and salts thereof, and ethylenically unsaturated phosphonic acids and salts thereof.

4. The process of claim 1, wherein the acrylamide- and/or methacrylamide-containing polymer contains monomer (c).

5. The process of claim 4, wherein said compounds having two or more ethylenically unsaturated moieties whose corresponding structural units in the polymer are stable under the reaction conditions of Hofmann degradation are selected from the group consisting of methylenebisacrylamides, triallylamine, tetraallylammonium chloride, and N,N'-divinylpropyleneurea.

6. The process of claim 1, wherein the acrylamide- and/or methacrylamide-containing polymer does not contain monomer (c).

7. The process of claim 1, further comprising preparing the paper stock comprising filler and at least one water-soluble polymer at a fibrous concentration of 20 to 40 g/l, and diluting the prepared stock comprising filler and at least one water-soluble polymer to a fibrous concentration of 3.5 to 15 g/l.

8. The process of claim 7, wherein the water-soluble polymer is added to a paper stock comprising filler and having a fibrous concentration of 20 to 40 g/l.

9. The process of claim 7, wherein the water-soluble polymer is added to a paper stock having a fibrous concentration of 20 to 40 g/l followed by adding the filler.

10. The process of claim 7, wherein the paper stock comprises a fibrous material having a freeness of ≤30° SR.

11. The process of claim 7, wherein the water-soluble polymer is added in an amount of 0.05 to 5.00 wt %, based on fibrous material.

12. The process of claim 7, wherein the water-soluble polymer is obtainable by subsequent postcrosslinking with a crosslinker selected from multifunctional epoxides, multifunctional carboxylic esters, multifunctional isocyanates, multifunctional acrylic or methacrylic esters, multifunctional acrylic or methacrylic amides, epichlorohydrin, multifunctional acyl halides, multifunctional nitriles, α,ω-chlorohydrin ethers of oligo- or polyethylene oxides or of other multifunctional alcohols, divinyl sulfone, maleic anhydride or w-halocarbonyl chlorides, multifunctional haloalkanes and carbonates.

13. The process of claim 1, wherein the draining of the paper stock on a wire section and the of the sheet on a press section are conducted in a papermaking machine.

14. The process of claim 1, wherein x ranges from 20 to 40 wt %.

15. The process of claim 1, wherein x ranges from 20 to 30 wt %.

16. The process of claim 1, wherein x ranges from 15 to 20 wt %.

17. The process of claim 1, wherein x ranges from 25 to 40 wt %.

18. The process of claim 1, wherein the fibrous material has a freeness of 20 to 30° SR.

19. The process of claim 1, wherein the paper stock contains 0.5 to 50 kg of the at least one water-soluble polymer per metric ton of dry fibrous material.

20. The process of claim 1, wherein the filler comprises at least one metal oxide, silicate and/or carbonate.

* * * * *